US005303868A

United States Patent [19]

Kroll

[11] Patent Number: 5,303,868

[45] Date of Patent: Apr. 19, 1994

[54] HOSE NOZZLE

[76] Inventor: John E. Kroll, Rte. 1. Box 519, Frostburg, Md. 21532

[21] Appl. No.: 44,760

[22] Filed: Apr. 12, 1993

[51] Int. Cl.[5] ..... B05B 1/16; B05B 9/01

[52] U.S. Cl. ..... 239/394; 239/526; 239/581.1; 251/113; 251/313

[58] Field of Search ..... 239/525, 526, 394, 581.1; 251/111, 113, 279, 313

[56] References Cited

U.S. PATENT DOCUMENTS

| | | | |
|---|---|---|---|
| 3,319,893 | 5/1967 | Rodgers et al. | 239/526 |
| 4,534,512 | 8/1985 | Chow et al. | 239/394 |
| 4,903,897 | 2/1990 | Hayes | 239/394 |
| 4,909,443 | 3/1990 | Takagi | 239/526 |
| 4,997,131 | 3/1991 | Heren | 239/581.1 |
| 5,232,162 | 8/1993 | Chih | 239/394 |

FOREIGN PATENT DOCUMENTS

| | | | |
|---|---|---|---|
| 405375 | 10/1924 | Fed. Rep. of Germany | 239/526 |
| 1599114 | 10/1990 | U.S.S.R. | 239/527 |

*Primary Examiner*—Karen B. Merritt
*Attorney, Agent, or Firm*—Leon Gilden

[57] ABSTRACT

A nozzle structure arranged for mounting to a garden hose and the like is provided, wherein an L-shaped nozzle structure having a trigger mounted within the nozzle is provided to impart selective fluid flow through an associated outlet conduit. The trigger member is arranged for sliding and reciprocation in a parallel orientation relative to the outlet conduit structure of the invention, and wherein a lock member is arranged to secure the trigger member in operative orientation, and wherein the trigger member is operative to effect manipulation of a rotary valve to direct fluid flow from a first conduit to a second conduit.

5 Claims, 4 Drawing Sheets

HOSE NOZZLE

BACKGROUND OF THE INVENTION

1. Field of the Invention

The field of invention relates to nozzle apparatus, and more particularly pertains to a new and improved hose nozzle wherein the same is arranged for ease of manual manipulation and operation in use.

2. Description of the Prior Art

Nozzle structure of various types are utilized throughout the prior art and exemplified by the U.S. Pat. Nos. 4,997,131; 4,776,517; 4,840,313; 4,508,272; and 3,497,141.

The instant invention attempts to overcome deficiencies of the prior art by providing for a nozzle structure arranged for ease of manipulation in use and convenience in orientation of fluid flow through the nozzle structure in a selective manner and in this respect, the present invention substantially fulfills this need.

SUMMARY OF THE INVENTION

In view of the foregoing disadvantages inherent in the known types of nozzle apparatus now present in the prior art, the present invention provides a hose nozzle wherein the same is arranged to permit the use of an L-shaped nozzle housing in cooperation with a reciprocatable trigger member. As such, the general purpose of the present invention, which will be described subsequently in greater detail, is to provide a new and improved hose nozzle which has all the advantages of the prior art nozzle apparatus and none of the disadvantages.

To attain this, the present invention provides a nozzle structure arranged for mounting to a garden hose and the like, wherein an L-shaped nozzle structure having a trigger mounted within the nozzle is provided to impart selective fluid flow through an associated outlet conduit. The trigger member is arranged for sliding and reciprocation in a parallel orientation relative to the outlet conduit structure of the invention, and wherein a lock member is arranged to secure the trigger member in operative orientation, and wherein the trigger member is operative to effect manipulation of a rotary valve to direct fluid flow from a first conduit to a second conduit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose nozzle which has all the advantages of the prior art nozzle apparatus and none of the disadvantages.

It is another object of the present invention to provide a new and improved hose nozzle which may be easily and efficiently manufactured and marketed.

It is a further object of the present invention to provide a new and improved hose nozzle which is of a durable and reliable construction.

An even further object of the present invention is to provide a new and improved hose nozzle which is susceptible of a low cost of manufacture with regard to both materials and labor, and which accordingly is then susceptible of low prices of sale to the consuming public, thereby making such hose nozzles economically available to the buying public.

Still yet another object of the present invention is to provide a new and improved hose nozzle which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
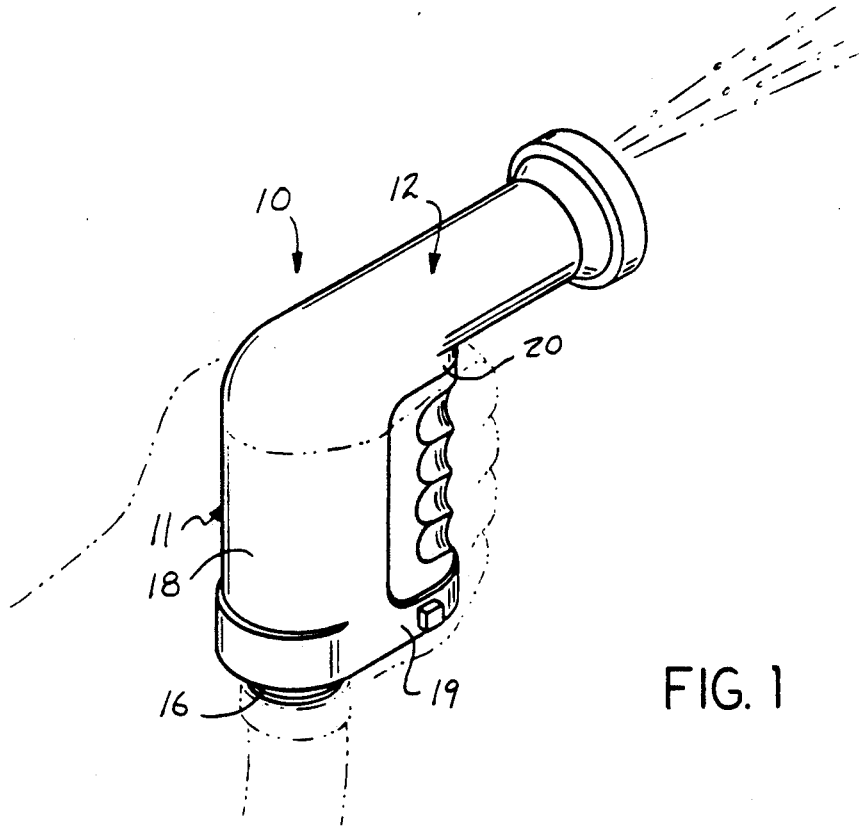
FIG. 1 is an isometric illustration of the invention.
Figure 2:
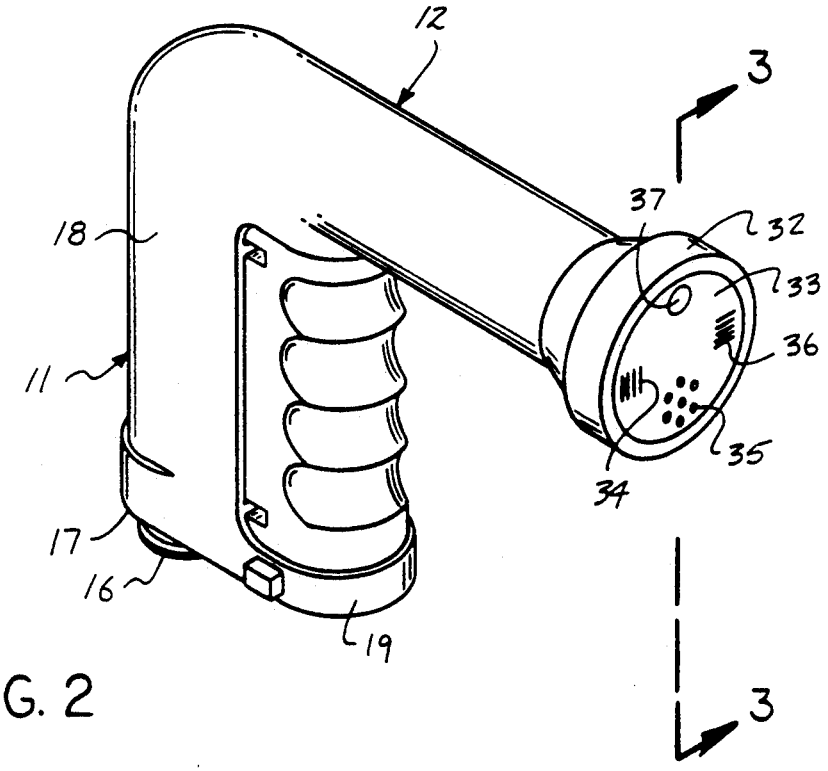
FIG. 2 is an isometric frontal view of the invention.

With reference now to the drawings, and in particular to FIGS. 1 to 8 thereof, a new and improved hose nozzle embodying the principles and concepts of the present invention and generally designated by the reference numerals 10 and 10*a* will be described.

Figure 3:
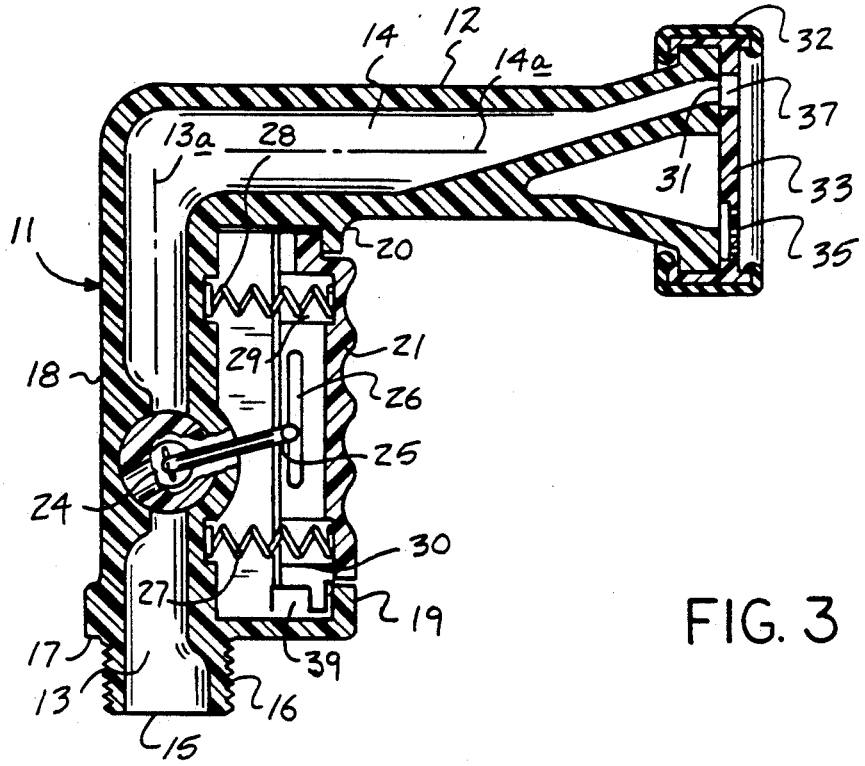
FIG. 3 is an orthographic view, taken along the lines 3—3 of FIG. 2 in the direction indicated by the arrows.

More specifically, the hose nozzle 10 of the instant invention essentially comprises a handle housing 11 integral and orthogonal relative to a directional housing 12 to define a unitary housing member of the nozzle structure 10, such that the first conduit 13 is directed through-extending the handle housing 11 in fluid communication with a second conduit 14 extending from the first conduit 13 to a second conduit exit end 31 at a forwardmost end of the directional housing 12 spaced from the handle housing 11 (see FIG. 3). The first conduit 13 includes a first conduit entrance 15 extending into the first conduit 13 through the handle housing 11 and entering the handle housing 11 through a handle housing bottom wall 17 and is spaced from the directional housing 12. The handle housing includes a handle housing side wall 18 that in turn includes a first handle band 19 integral with the side wall 18 and positioned in adjacency relative to the housing bottom wall 17, with a second handle band 20 mounted to the handle housing 11 and the directional housing 12 at their intersection, such that a trigger member 21 is captured between the first and second handle bands 19 and 20 and extends therebetween for effecting rotation of a valve cylinder 22 (see FIG. 4) positioned within the first conduit 13 within the handle housing 11. An externally threaded housing boss 16 permits securement of a fluid hose thereto.

Figure 4:
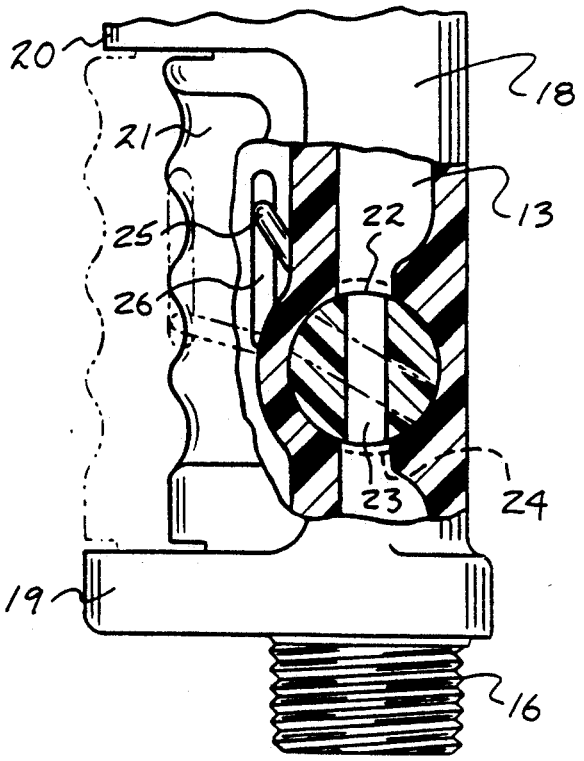
FIG. 4 is an orthographic partial view, indicated partially in cross-section, to indicate the use of the valve cylinder mounted within the first conduit of the nozzle structure.
Figure 5:
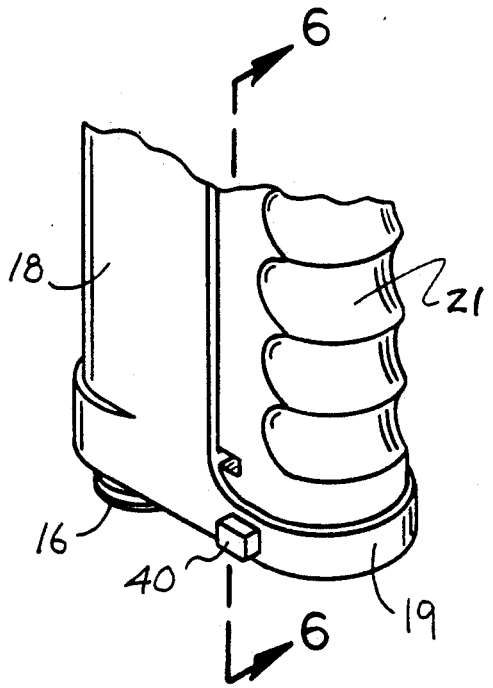
FIG. 5 is an enlarged isometric illustration of a lowermost portion of the housing and the lock button.
Figure 5A:
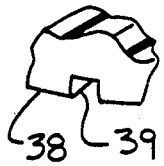
FIG. 5*a* is an enlarged isometric illustration of the lowermost trigger member slot receiving a lock button.
Figure 6:
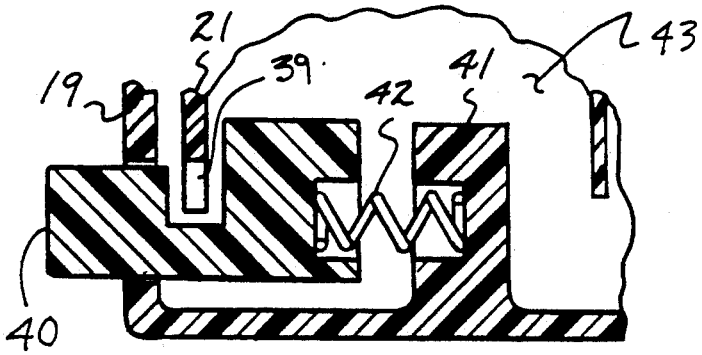
FIG. 6 is an orthographic view, taken along the lines 6—6 of FIG. 5 in the direction indicated by the arrows indicating the reception of the lock button within the trigger member.

The valve cylinder 22, as indicated in FIG. 4, includes a valve cylinder conduit 23 directed therethrough arranged in a first position transversing the first conduit 13 and in a second position, as illustrated in solid line, in fluid communication through the first conduit 13, wherein a support plate 24 mounted laterally of the valve cylinder 22 and in fixed communication to the valve cylinder (see FIGS. 3 and 4) is mounted coaxially of the valve cylinder and is operative through an actuator link 25 fixedly mounted to the valve cylinder such that a first end of the actuator link 25 is mounted to the valve cylinder coaxially thereof, with a second end of the actuator link 25 received within an actuator link slot 26 within the reciprocatable trigger member 21. Respective first and second spring members 27 and 28 are mounted between the handle housing 11 and received within respective first and second wells 30 and 29 within the trigger member 21, such that the first and second spring members 27 and 28 are spaced an equal distance relative to the first and second handle bands 19 and 20 for maintaining alignment of the trigger member 21 between the handle bands and for biasing the trigger member 21 in an extended orientation, as indicated in FIG. 3, relative to a retracted orientation to effect fluid flow through the first conduit, in a manner as indicated in FIG. 4. It should be further noted that the trigger member 21 includes a trigger member bottom wall 38, having a trigger slot 39 arranged to receive a lock button 40, as indicated in FIG. 6, wherein the lock button 40 includes a lock button slot to receive the trigger member therethrough, as the trigger member includes a trigger member cavity 43 extending around the lock button 40 and an associated abutment boss 41 within the trigger member cavity 43 and a lock button spring 42 interposed between the abutment boss 41 and the lock button to normally orient the lock button slot in alignment with the lowermost edge or bottom wall 38 such that retraction of the trigger member 21 to the second position, as indicated in FIG. 4 in solid line, for the first position, as indicated in phantom in FIG. 4, aligns the trigger member slot 39 with the lock button and such that biasing of the first and second spring members 27 and 28 against the trigger member frictionally maintains the lock button in engagement within the trigger member slot 39, and wherein the trigger member slot 39 being of a greater width than the lock button 40, displacement or disengagement of the lock button 40 relative to the trigger member bottom wall 38 within the slot 39 releases the lock button to the projected orientation, as indicated in FIG. 6.

The second conduit 14, as indicated, is symmetrically oriented about a second conduit axis 14*a* that intersects a first conduit axis 13*a*, as indicated in FIG. 3, wherein a cylindrical collar 32 is rotatably mounted about the second conduit exit end 31 mounting a flow metering disc 33 such that the cylindrical disc is rotatably mounted about the forwardmost end of the second conduit 14 and the cylindrical collar 32 coaxially aligned with the axis 14*a* such that the flow metering disc 33 includes a radial array of spaced flow slots to include a first, second, third, and fourth flow slot configuration 34, 35, 36, and 37 respectively to direct selective fluid flow through the metering disc. The first flow slots 34 and the second flow slots 35 are indicated as orthogonally oriented relative to one another to provide for a spray and stream of such water in a contrasting manner relative to the first and second flow slots, wherein a flow cylindrical opening defines the third flow configuration, and wherein a matrix of flow apertures 37 defines the fourth flow configuration.

Figure 7:
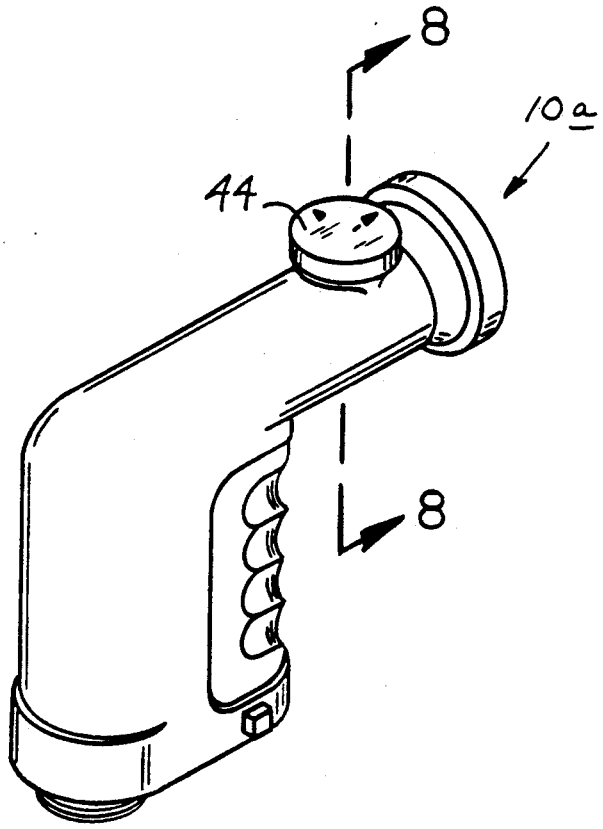
FIG. 7 is an isometric illustration of a modified aspect of the invention employing a valve cylinder within the second conduit.
Figure 8:
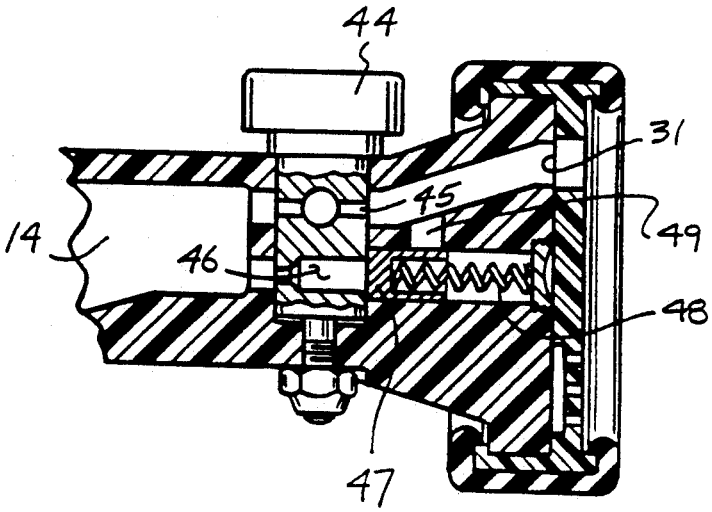
FIG. 8 is an orthographic view, taken along the lines 8—8 of FIG. 7 in the direction indicated by the arrows.

The FIGS. 7 and 8 indicates the use of an optional valve cylinder arrangement 44 within a modified hose nozzle structure 10*a* that is substantially identical with the exception of the first cylinder structure 44 mounted within the second conduit 14. The valve cylinder 44 includes a valve cylinder first conduit 45 in fluid communication with the second conduit 14 and substantially aligned therewith such that a valve cylinder second conduit 46 is oriented in a displaced orientation relative to the valve cylinder first conduit 45 in fluid communication with the second conduit exit end 31 through a connecting conduit 49 in fluid communication with the valve cylinder second conduit 46, wherein a plunger 47 in biased communication with the valve cylinder 44 arranged for alignment with the valve cylinder second conduit 46 includes a plunger spring 48 interposed between the flow metering disc 33 and the plunger 47, whereupon in this manner pulsed fluid flow through the connecting conduit is effected such that the plunger spring 48 is systematically displaced permitting pulsed fluid flow through the connecting conduit 49 upon buildup of pressure against the plunger 47 to displace the plunger permitting fluid flow to the connecting conduit 49 into communication with the second conduit exit end 31.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hose nozzle, comprising, a unitary housing, including a handle housing in integral and orthogonal communication with a directional housing, the handle housing having a first conduit symmetrically oriented about a first axis, and the directional housing having a second conduit in fluid communication with the first conduit, with the second conduit symmetrically oriented about a second axis, the handle housing having a handle housing bottom wall, and the directional housing having a directional housing forwardmost end spaced from the handle housing, wherein the second conduit terminates in a second conduit exit end through the forwardmost end, and the second conduit exit end is offset relative to the second axis, and the forwardmost end including a cylindrical collar rotatably mounted about the forwardmost end orthogonally oriented relative to the second axis, and the cylindrical collar including a flow metering disc, the flow metering disc including at least a first and a second flow metering aperture matrix therethrough, wherein the first and second flow metering aperture matrix are oriented a predetermined spacing relative to the second axis, and wherein the second conduit exit end is offset relative to the second axis at said predetermined spacing to permit selective alignment of one of the first and second flow metering aperture matrix with said second conduit exit end, and the first conduit includes a valve cylinder rotatably mounted within the first conduit, and the valve cylinder having a valve cylinder conduit directed diametrically through the valve cylinder permitting selective traversing of the valve cylinder conduit relative to the first conduit, and fluid flow communication of the valve cylinder conduit with the second conduit upon rotation of the valve cylinder relative to the first conduit, and the valve cylinder includes a support plate fixedly, coaxially, and laterally offset relative to the valve cylinder oriented exteriorly of the first conduit such that the valve cylinder support plate includes an actuator link fixedly mounted to the valve cylinder support plate by having a first end of the actuator link secured to the valve cylinder support plate, and the actuator link having an actuator link second end arranged for rotative displacement relative to the first conduit.

2. A hose nozzle as set forth in claim 1 wherein the handle housing includes a first band mounted to the handle housing in adjacency to the handle housing bottom wall, and a handle housing second band mounted to the handle housing and to the directional housing, wherein the first band and the second band are arranged in a parallel coextensive relationship, and wherein a trigger member is reciprocatably mounted and coextensively oriented between the first band and the second band, and wherein the trigger member includes a trigger member slot, and the actuator link second end is received within the trigger member slot.

3. A hose nozzle as set forth in claim 2 including a first spring and a second spring, with the actuator link interposed intermediate the first spring and the second spring, and the first spring and the second spring are received within a first well and a second well respectively within the trigger member, and are arranged in simultaneous abutting engagement with the handle housing to bias the trigger member in a displaced orientation relative to the handle housing.

4. A hose nozzle as set forth in claim 3 wherein the trigger member includes a trigger member bottom wall, the trigger member bottom wall including a trigger member slot, and a lock button reciprocatably directed through the first band arranged for selective reception within the trigger member slot for securing the trigger member in adjacency to the handle housing, and the trigger member bottom wall includes a trigger member cavity, and an abutment boss mounted within the trigger member cavity fixedly secured to the first band, with a lock button spring interposed between the abutment boss and the lock button to displace the lock button relative to the trigger member.

5. A hose nozzle as set forth in claim 4 further including a second valve cylinder mounted within the second conduit in adjacency to the second conduit exit end, wherein the second valve cylinder includes a second valve cylinder first conduit in fluid communication with the second conduit, and the second valve cylinder having a second valve cylinder second conduit spaced from the second valve cylinder first conduit, and a plunger arranged for abutment with the second valve cylinder and the second valve cylinder second conduit, and a plunger spring interposed between the plunger and the flow metering disc, with a connecting conduit arranged for fluid communication with the second valve cylinder second conduit upon displacement of the plunger relative to the second valve cylinder second conduit, wherein the second conduit is oriented between the second valve cylinder and the second conduit exit end.

* * * * *